US006454534B1

(12) United States Patent
Burnett et al.

(10) Patent No.: US 6,454,534 B1
(45) Date of Patent: Sep. 24, 2002

(54) FLUSH BUCKET COVER

(75) Inventors: Mark E. Burnett, Buskirk, NY (US); Daniel R. Trembley, Old Town; Maurice D. Fournier, Hermon, both of ME (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/741,004

(22) Filed: Dec. 21, 2000

(51) Int. Cl.[7] ..... F01D 25/04
(52) U.S. Cl. ..... 416/190
(58) Field of Search ..... 416/190, 210 R, 416/214 R, 222; 415/209 R, 210.1, 191, 196, 195

(56) References Cited

U.S. PATENT DOCUMENTS

| | | | | |
|---|---|---|---|---|
| 2,315,655 A | * | 4/1943 | Redding | 416/190 |
| 2,336,859 A | * | 12/1943 | Gooch | 416/190 |
| 2,724,544 A | * | 11/1955 | Hardigg | 416/195 |
| 3,185,441 A | | 5/1965 | Reuter | 253/77 |
| 3,328,867 A | | 7/1967 | Guengant | 29/156.8 |
| 3,572,968 A | * | 3/1971 | Musick et al. | 416/190 |
| 3,752,599 A | | 8/1973 | Pace | 416/190 |
| 3,981,615 A | | 9/1976 | Krol | 416/190 |
| 4,710,102 A | | 12/1987 | Ortolano | 416/190 |
| 4,781,532 A | | 11/1988 | Novacek et al. | 416/222 |
| 4,840,539 A | | 6/1989 | Bourcier et al. | 416/191 |
| 5,133,643 A | * | 7/1992 | Ortolano | 416/195 |
| 5,211,540 A | | 5/1993 | Evans | 416/190 |
| 5,238,368 A | | 8/1993 | Ortolano | 416/191 |
| 5,261,785 A | | 11/1993 | Williams | 415/169.2 |
| 6,036,437 A | | 3/2000 | Wolfe et al. | 415/173.003 |

FOREIGN PATENT DOCUMENTS

JP 59-215904 * 5/1983

* cited by examiner

*Primary Examiner*—Edward K. Look
*Assistant Examiner*—James M McAleenan
(74) *Attorney, Agent, or Firm*—Banner & Witcoff, Ltd.

(57) ABSTRACT

A bucket cover to be attached to the tip of a turbine bucket has an aperture with an engageable geometry for receiving a tenon extending from the bucket and retaining the bucket cover to the bucket. The cover has an outer planar surface, an inner planar surface to abut against the bucket and an aperture extending between its surfaces. The aperture is defined by a sidewall that has multiple surfaces of varying cross-sectional size so as to structurally engage a tenon that is deformed during assembly. The sidewall of the aperture has a concave curved portion adjacent the outer planar surface leading to a narrow throat portion that corresponds generally to the size and shape of an undeformed tenon. In a method of making a turbine blade attached to a bucket cover, after a tenon is received in the aperture, the tenon is deformed by application of compressive force so that the tenon fills the aperture of the cover. The deformed tenon engages the various surfaces of the aperture sidewall to secure the cover on the bucket. The button head that is formed on the outer planar surface of the cover by excess tenon material is removed along with a thin layer of the outer planar surface of the bucket in order to provide a smooth, flush outer surface.

21 Claims, 5 Drawing Sheets

FLUSH BUCKET COVER

BACKGROUND OF THE INVENTION

The present invention relates to turbomachinery and more particularly, to a bucket cover having an aperture structure for mounting to a turbine blade. In turbomachinery equipment, bucket covers are connected to the top ends of turbine blades or buckets to dampen vibration and prevent twisting of the blades. The bucket covers work with a seal to keep gas or steam from leaking away from the turbine blades. Some bucket covers are integrally formed with the turbine blades. Other bucket covers are small flat plates attached to the end of the bucket by reception of a tenon on the bucket through an opening in the cover and deforming the tenon to form a button on the outer surface. During operation of the turbomachinery equipment, a centrifugal force tends to pull the bucket covers away from the top end of the turbine blades, thus it is critical that the bucket cover be securely fastened to the tenon so that the cover stays connected for long periods of operational cycles.

Each turbine blade or bucket has an upwardly projecting tenon that is received in an aperture of a mating bucket cover. Once a cover is fitted onto the tenon, the bucket cover is attached to the turbine blade by peening or deforming the tenon to form a button head on top of the aperture to secure the cover to the blade similar to a rivet. In the manufacture and maintenance of turbine equipment, manual peening lengthens the cycle time to attach the bucket covers to the turbine blades. FIG. 1 shows a partial sectional view of a conventional deformed "button" tenon and a bucket cover 1. The excess deformed material as a result of peening the tenon remains as a rounded button 2 on the top surface of the bucket cover. The opening 4 in the conventional cover 1 is straight-sided and provides no structure to engage the deformed tenon. Also, conventional "button" tenon and cover configurations did not provide an optimum steam sealing surface. In addition, during operation, the excess material erodes away due to solid particle erosion within the turbine. The solid particle erosion and the centrifugal force tends to weaken the conventional button cover fastening arrangement shortening the cycle time between replacement and inspections.

FIG. 2 shows a partial sectional view of a another prior art connection between a bucket and its cover 1. One proposed solution to the solid particle erosion problems of button assemblies was to provide a "foxhole" or recess 6 in cover 1 to accommodate the button 2. The "foxhole" bucket covers must also be manually peened thereby lengthening manufacturing time. Further, opening 4 has a straight sidewall that provides no structure to help retain the deformed tenon. In addition, this foxhole arrangement is still affected by solid particle erosion by providing sharp angular areas where solid particles can collect. The solid particle erosion and the centrifugal force still tends to weaken the "foxhole" cover fastening arrangement. While, the cycle time between replacement and inspections might have been slightly improved with this design, any further improvement in cycle time is advantageous.

Thus, what is needed is an apparatus and method of securing a bucket cover to a turbine bucket so that the attachment is secure, assembly efficient and cycle time between periodic maintenance inspections lengthened.

BRIEF SUMMARY OF THE INVENTION

Briefly, in one embodiment of the present invention, a flush bucket cover addresses the drawbacks of the conventional covers by providing structural modifications, which result in both operational and manufacturing advantages. The aperture in the inventive bucket cover has a complex geometry compared to the straight-sided apertures of the prior art. Broadly, the aperture has multiple surfaces in the sidewall so that when the tenon is deformed to fill the aperture during assembly, the tenon will be structurally engaged to the sidewall surfaces of the aperture. More specifically, moving from the outer surface of the cover toward the inner surface which is in contact with the bucket, the aperture has a relatively large outer opening with a periphery defined by a curved shoulder. A beveled surface transitions the sidewall to a vertical throat which has a size corresponding generally to the tenon size, and another beveled surface transitions from the vertical throat to the inner surface of the cover. Seen in cross-section, the aperture resembles a chalice shape with the larger mouth of the chalice shape defining the outer surface of the aperture, and the narrowest throat of the chalice shape defining the size of the tenon. To assemble the cover to the bucket, a tenon of the bucket is received in the aperture with a portion of the tenon extending above the outer surface of the cover. The protruding portion of the tenon is worked by peening to deform the entire tenon to fill the aperture. In this way the tenon takes on the shape of the aperture. The deformed tenon is thereby engaged to multiple surfaces of the aperture to secure the cover to the bucket.

In a completely assembled bucket and cover, a turbine bucket has a deformed tenon extending from a radial tip of the turbine blade and a bucket cover portion attached to the radial tip. The bucket cover comprises an aperture having an engageable geometry to retain the deformed tenon having a mating geometry that fills the aperture. Thus the bucket cover is fastened to the turbine bucket by the aperture and tenon structure.

A method of assembling a bucket cover to a turbine bucket for turbomachinery equipment, comprises the steps of: fitting a bucket cover with an opening having a plurality of sidewall surfaces onto a tenon of a turbine bucket so that a portion of the tenon extends above an outer surface of the cover; applying compressive force to the tenon so as to deform the tenon and thereby fill the opening of the cover and forming a button head on the outer surface of the cover; removing the button head and a planar portion of the cover to provide an assembly in which the tenon and the bucket cover are flush with one another.

The present invention thus provides a cover or shroud for turbine buckets, which has an aperture with an engaging structure for retaining a deformed tenon of a bucket. This structural attachment of the aperture-tenon connection provides a secure connection that is more resistant to centrifugal forces than a conventional button head attachment. In addition, the structure of the aperture-tenon connection also enables the button head to be removed so as to eliminate solid particle erosion problems. These advantages result in a more reliable attachment, which increases the time between maintenance intervals.

DETAILED DESCRIPTION OF THE INVENTION

Figure 1:
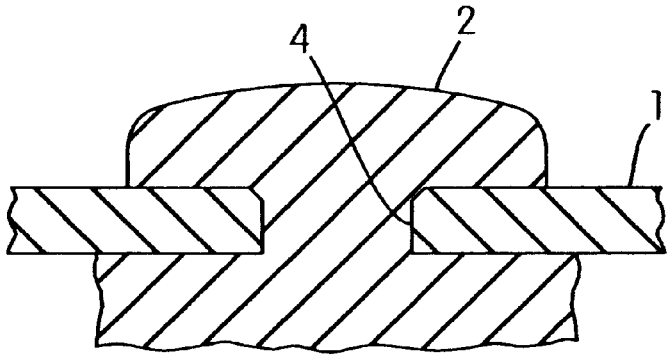
FIG. 1 PRIOR ART
FIG. 1 is a partial sectional view of a conventional peened "button" tenon and bucket cover.
Figure 2:
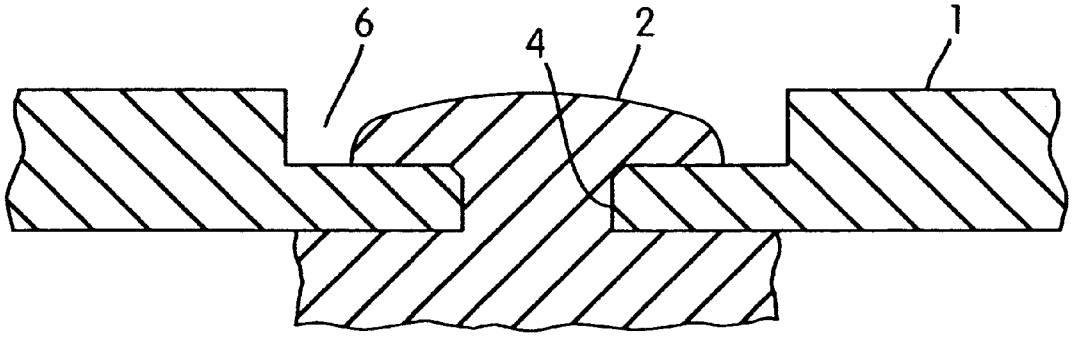
FIG. 2 PRIOR ART
FIG. 2 is a partial sectional view of a conventional tenon and "foxhole" bucket cover arrangement.
Figure 3:
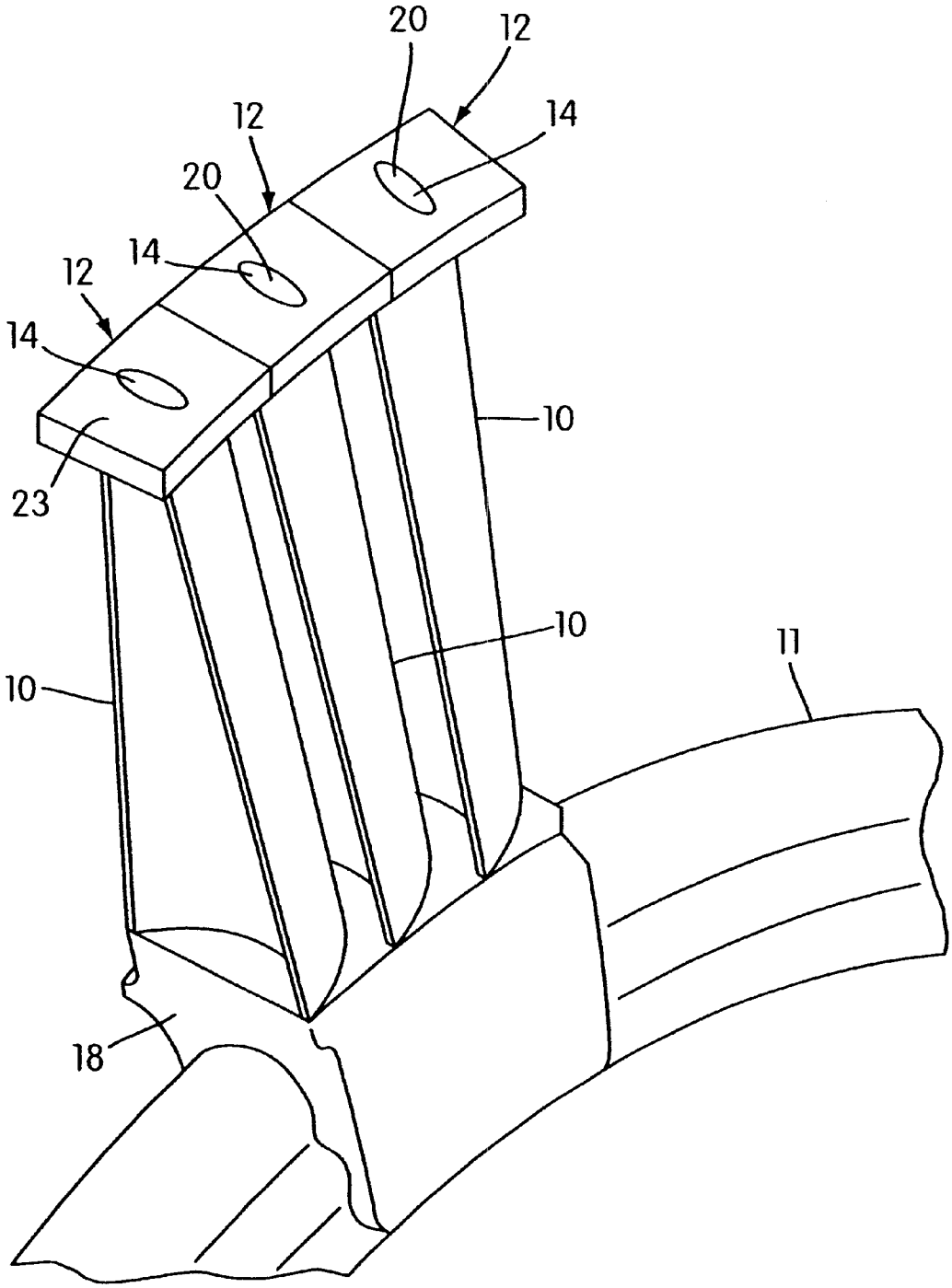
FIG. 3 is a partial perspective view of an exemplary embodiment of a turbine wheel with turbine buckets having bucket covers attached thereto.
Figure 4:
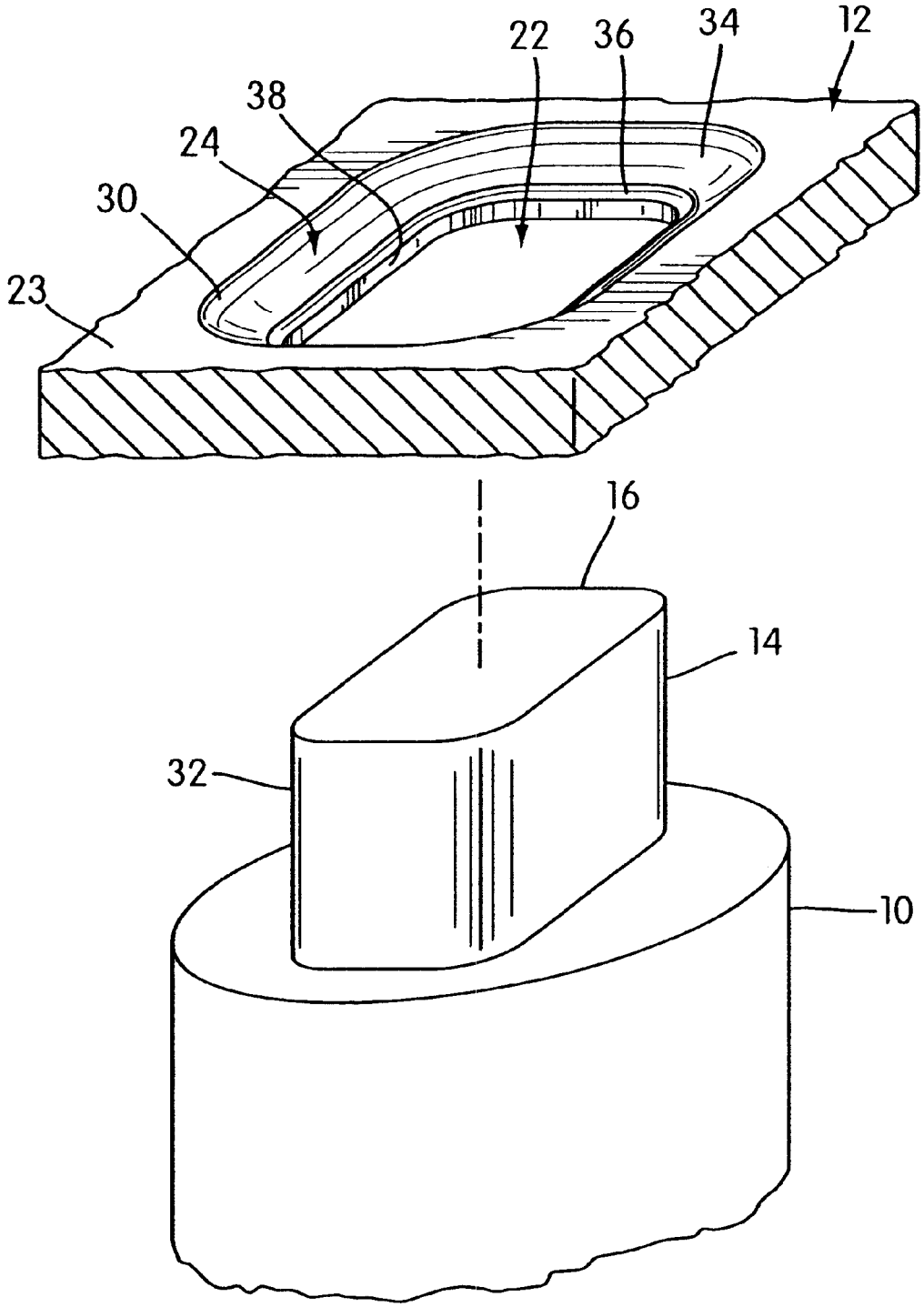
FIG. 4 is a perspective assembly view of an exemplary embodiment of a portion of a bucket cover and a tenon of a turbine blade of FIG. 3.
Figure 7:
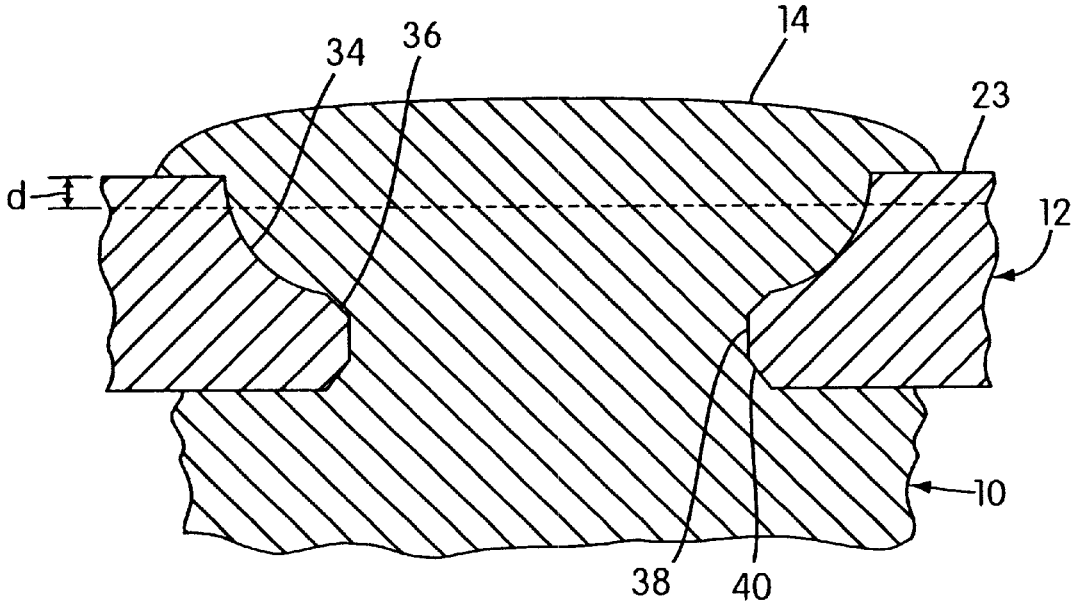
FIG. 7 is a cross-sectional view similar to FIG. 6 of the tenon and bucket cover arrangement of FIG. 4 after deformation of the tenon.
Figure 8:
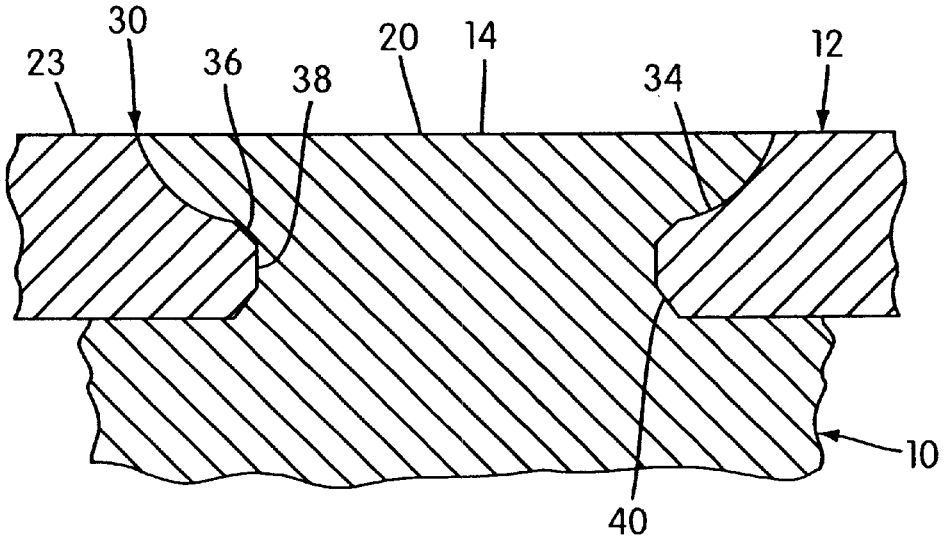
FIG. 8 is a cross-sectional view of the tenon and bucket cover of FIG. 7 after machining to provide a flush bucket cover.

Referring to FIGS. 3 and 4, a plurality of turbine blades 10 are radially mounted at regular intervals around a rotor wheel 11. Each turbine blade or bucket 10 comprises a bucket cover or shroud 12, a tenon 14 extending from a radial tip 16, and a root or base 18 for mounting to rotor wheel 11. Bucket cover 12 is attached to radial tip 16 of the turbine blade in which an outer surface 20 of the tenon and an outer surface of the bucket cover are flush with one another. Bucket cover 12 comprises an aperture 22 having a sidewall with an engageable geometry for engaging and retaining a tenon deformed to fill the aperture as shown in FIGS. 7 and 8. The engageable geometry can be a broad variety of multiple surfaces such that when the tenon is peened and deformed during assembly, the bucket cover is fixed relative to the turbine bucket, and remains securely fixed during operation of the turbine.

Figure 5:
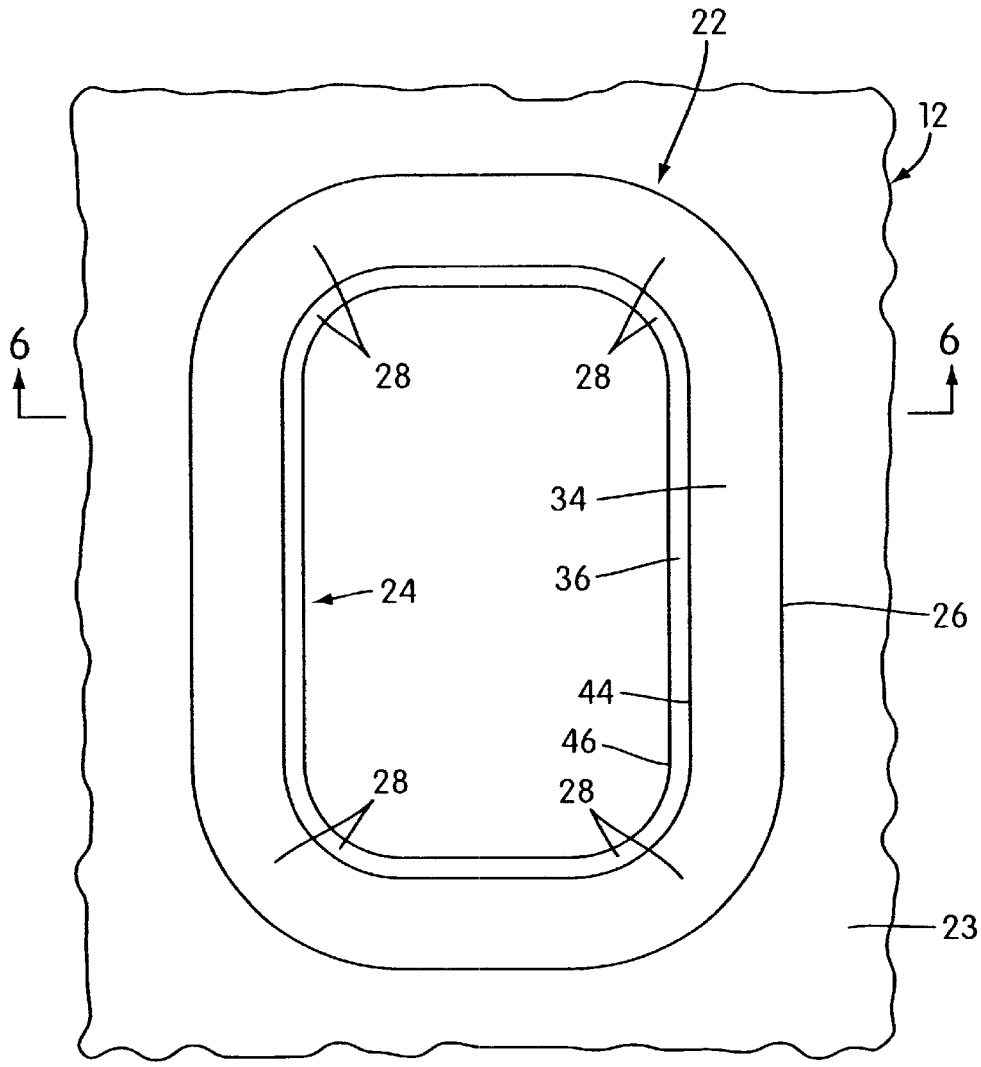
FIG. 5 is a partial top plan view of the bucket cover of FIG. 4.

In the embodiment of the invention described herein, aperture 22 has a shoulder 24 which when filled with the deformed tenon will provide a mating protrusion in the tenon. FIG. 5 illustrates a partial top plan view of the bucket cover 12 with aperture 22. Outer periphery 26 of aperture 22 resembles a rectangle having rounded corners, and moving from the outer periphery to the inner periphery, aperture 22 includes several radii 28 for the rounded corners of the various surfaces. These radii can be varied or adjusted accordingly to the proportions of undeformed tenon 14. Also, the width and length of aperture 22 may be adjusted to the portions of the undeformed tenon 14. Although a generally rectangular shape for a tenon is shown in the drawings, any number of shapes for the tenon and mating aperture such as circular, oval, airfoil shaped or other geometry, are contemplated to be within the scope of the invention.

Aperture 22 comprises a sidewall 30 extending between an outer surface 23 and an inner surface 25 of bucket cover 12. Sidewall 30 comprises a shoulder portion 24 extending from the sidewall and toward the center axis of aperture 22. In operation, shoulder portion 24 abuts against and engages a mating, outer peripheral surface 32 of tenon 14, in a deformed state, to secure bucket cover 12 in place. Besides shoulder portion 24, sidewall 30 has a plurality of engagement surfaces for retaining deformed tenon 14: a curved surface 34 forming the shoulder portion, a beveled surface 36 transitioning between the shoulder portion and a vertical throat surface 38 and an inner bevel surface 40 transitioning between the throat surface and the inner planar surface 25 of the cover. Each surface is described in detail herein.

Curved surface 34 extends downward from outer planar surface 23 and includes a concave or bowl-like structure inside of the periphery of aperture 22 to define shoulder portion 24. The shape of curved surface 34 was determined by examining the shape of a tenon which was peened while unrestrained, and resembles a mushroom shape. By designing surface 34 in this manner, the aperture of the present invention takes advantage of the tenon's natural deformation tendencies under compressive force, and thereby presents an aperture that can be filled when the tenon is deformed without excess handling or molding of the material. In some applications, it will be advantageous to size radius 29 to the proportions of a tenon that was deformed unrestrained.

Bevel surface 36 is a transition surface integrally formed between curved surface 34 and vertical throat surface 38. Bevel surface 36 comprises an inclined surface extending between an outer edge 44 adjacent to curved surface 34, and an inner edge 46 adjacent to vertical throat 38.

Figure 6:
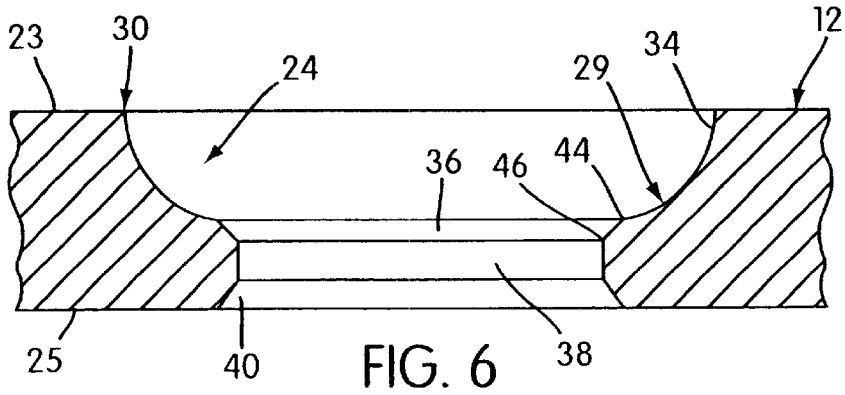
FIG. 6 is a cross-sectional view of the bucket cover taken along line 6—6 of FIG. 5.

Vertical throat surface 38 is disposed substantially in a perpendicular direction relative to outer planar surface 20 and inner planar surface 25. The peripheral shape of vertical throat surface 38 is adapted to mate with the corresponding outer peripheral surface 32 of tenon 14, as shown in FIG. 4. Inner bevel surface 40 comprises an inclined surface extending between and transitioning between vertical throat surface 38 and inner planar surface 25. As seen in FIGS. 6–8, these multiple surfaces of aperture 22 in the cover present multiple surfaces of engagement for a tenon that is deformed to fill aperture 22. Because the vertical throat surface 38 is narrower than both the outer curved surface 34 and inner bevel surface 40, when a tenon is deformed in the aperture the tenon material will abut against these surfaces, and engage the cover on the bucket, FIGS. 7–8. The aperture with its mating deformed tenon provide structural engagement of the bucket and bucket cover without having to rely on a button head formed at the outer surface of the cover as in the prior art.

The present invention is not limited to the illustrated embodiments of the engageable geometry of aperture 22. Broadly aperture 22 includes a variable cross sectional shape that structurally engages deformed tenon 14. The engageable geometry or cross sectional shape may be any structure that extends into the aperture of a bucket cover and secures it after a tenon is deformed to fill the aperture. In other embodiments of the invention, the engageable geometry can be formed by a series of grooves, thread-like extensions, a convex protrusion, prismic or other structures that extend from the sidewall of the aperture.

In the embodiment of the invention shown in FIGS. 3–8, resistance to a shear force between sidewall 30 and the deformed tenon is significantly increased by the engageable geometry of aperture 22. This resistance to shearing is advantageous because during operation, rotor wheel 11 develops a substantial dynamic centrifugal force acting on bucket cover 12 that tends to separate it from the turbine blade. Under the effect of the centrifugal force, a shear force is exerted along the sidewall of aperture 22, and this shear force can result in the cover being broken away through the deformed tenon. This is a problem with prior art tenons which are disposed in straight-sided apertures and fastened to the turbine bucket tip only by the button head formed at the outer surface.

The structural engagement of the deformed tenon in the aperture of the present invention increases the assembly's resistance to these forces. To test for resistance to those forces, pull strength is herein defined as the force magnitude at which the bucket cover will separate from the turbine blade. This pull strength serves a proxy for the developed shear force due to rotation of the turbine. Tests of an embodiment of a bucket cover has shown the pull strength has been increased at least 16% over required threshold levels. The present invention advantageously reduces the likelihood that bucket cover 12 will slice or shear through deformed tenon 14. Thus, the multiple surface aperture extends the operational life of the turbine and lengthens the periodic maintenance cycle for inspection and repair.

Also, advantageously, since the engagement of the deformed tenon and the aperture occurs between outer surface 23 and inner surface 25, there is no longer a use or need for a top button head formed during tenon deformation to remain on the outer surface. So in applications where a flush outer surface is desired, after the bucket cover is assembled to the tenon, and the tenon deformed, the button head along with a thin layer off of the outer surface is removed by machining or other suitable means to provide a flush surface between bucket cover 12 and the bucket tenon 14, FIGS. 7–8. Providing the flush outer surface eliminates the problems experienced with solid particle erosion in the past. In addition, since the tenon button head is removed, the particular shape of the button head is less important than with conventional techniques. The assembly of the present invention is therefore more amenable to automated peening operations which can significantly reduce manufacture time and therefore costs.

The method of making or assembling each turbine blade 10 with bucket cover 12 is now described. Bucket cover 12 fits over undeformed tenon 14 during a rotor wheel assembly process, FIG. 4. Undeformed tenon 14 is extended into and through aperture 22 of bucket cover 12 so that the bucket cover is seated on the radial tip of the turbine blade with its outer surface 23 exposed, and its inner surface 25 abutting against the blade.

The tenon is then deformed so that the tenon material fills aperture 22 to provide a secure structural engagement, FIGS. 7–8. The tenon can be deformed by any suitable localized compressive force applied to the tenon, such as manual or automated peening. This compressive force may be radially aligned with the turbine blade.

After the tenon is deformed, a button head is formed on the outer surface of the cover. The button head along with a thin layer, d, of the outer surface of the cover is removed, FIG. 7. This removal step makes the top surface of the bucket cover and the exposed part of the tenon flush with one another and presents a smooth outer surface. The removal of material can be accomplished in a number of ways. In a preferred embodiment, the assembled turbine bucket with the deformed tenon button head is turned on a lathe. The lathe provides a controlled cutting process. Other machining processes may be used as well. In this manner, a smooth outer surface of the bucket cover is provided to improve surface erosion problems experienced with the prior art. In contrast to the conventional foxhole aperture, the flush bucket cover of the present invention also eliminates any spaces in which solid particles can collect.

The bucket cover can be constructed of various metals suitable for use in turbomachinery. The bucket cover can be molded or machined using conventional manufacturing processes, including the engagement surfaces 34, 36, 38 and 40 within aperture 22. For instance, bevel surface 36 and inner bevel surface 40 can be made by machining a chamfer on those respective edges. Thus, the cost to make the bucket cover is relatively inexpensive, particularly in light of the structural advantages it provides.

In an embodiment of the bucket cover, various types of turbomachinery can benefit from using the present invention. Bucket cover 12 can replace a conventional foxhole bucket cover to provide improved sealing with a labyrinth seal in steam turbines and reduce solid particle erosion. The size and shape of the bucket cover is not limited by the embodiments of the present invention. While a single bucket cover has been described having aperture 22, a common bucket cover may have a plurality of apertures to accommodate a series of adjacent turbine blades. The apertures would have the previously described geometry. Also, the outer geometry of the bucket cover 12 can be any appropriate configuration, such as a "Z"-shape configuration as disclosed in commonly assigned U.S. Pat. No. 6,036,437 to Wolfe et al., which is herein incorporated by reference.

Thus, what has been described are embodiments of a bucket cover having an aperture with intersecting surfaces that retains and engages a tenon in a deformed state. This aperture keeps the bucket cover securely fastened to the radial tip of a turbine blade. The bucket cover may have a flush outer surface for improved sealing within a turbine.

While the invention has been described with reference to preferred or exemplary embodiments, it will be understood by those of ordinary skill in the art that various changes may be made and equivalents may be substituted for elements thereof without departing form the scope of the invention. In addition, many modifications may be made to adapt to particular situations or materials to the teachings of the invention without departing from the scope thereof. Therefore, it is intended that the invention not be limited to the particular embodiment disclosed, but that the invention will include all embodiments falling within the scope of the appended claims.

What is claimed is:

1. A cover adapted to attach to a turbine blade having a tenon extending radially therefrom, said cover comprising:

an outer surface;

an inner surface adapted to abut against the turbine blade; and an aperture extending between said outer surface and said inner surface, said aperture defined by a sidewall having at least two surfaces angled relative to one another for engaging the tenon when the tenon is deformed to fill said aperture, wherein said sidewall includes a curved surface adjacent to said outer surface to define an outer opening of said cover.

2. The cover of claim 1, wherein said at least two surfaces define a passage in said aperture that is smaller in cross-section than said aperture at said outer surface.

3. The cover of claim 1, wherein said sidewall further includes a substantially perpendicular surface perpendicular to said outer surface and defining a passage of said aperture narrower than said outer opening and adapted to correspond to the shape of an undeformed tenon.

4. The cover of claim 3, wherein said sidewall further includes an inclined surface to transition between said curved surface and said perpendicular surface.

5. The cover of claim 3, wherein said sidewall further includes an inner inclined surface transitioning between said perpendicular surface and said inner surface and defining an inner opening to said aperture.

6. The cover of claim 1, wherein said curved surface is concave relative to said outer surface.

7. A turbine blade assembly comprising:

a turbine blade having a deformable tenon extending from a radial tip of the blade; and a shroud having opposing surfaces and an aperture with a sidewall structure having at least two sections of varying cross-sectional size extending therethrough, said tenon received in said aperture and engaging said sidewall structure when the tenon is deformed to fill said aperture, wherein at least one of said sections comprises a concave section relative to one of said opposing surfaces of said shroud.

8. The assembly of claim 7, wherein said sidewall structure further comprises a throat section adjacent to said concave section, said throat section having a cross-sectional area smaller than said concave section.

9. The assembly of claim 8, wherein said sidewall structure further includes an inclined surface to transition between said concave section and said throat section.

10. The assembly of claim 7, wherein at least one of said opposing surfaces includes an outer surface of said shroud being substantially flush with said tenon when said tenon is deformed in said aperture.

11. A method of making a turbine bucket with a turbine bucket cover comprising:

inserting a tenon of the turbine bucket through an aperture with at least two sections of varying size in the bucket cover, wherein said aperture includes a curved section in one of said sections of varying size; and deforming the tenon so that the tenon material fills the aperture and engages the sections of the aperture to thereby attach the bucket cover to the turbine bucket.

12. The method of claim 11, further comprising the step of removing deformed tenon material extending beyond the aperture.

13. The method of claim 12, wherein said step of removing tenon material also includes removing a layer of the bucket cover material to provide a flush outer surface.

14. The method of claim 11, wherein said step of deforming the tenon comprises applying compressive force to the tenon.

15. The method of claim 14, wherein said step of applying compressive force to the tenon comprises peening.

16. The method of claim 15, wherein said step of applying compressive force comprises automated peening.

17. The method of claim 14, wherein the curved section is concave.

18. A shroud adapted to attach to a turbine blade having a tenon extending radially therefrom, said shroud comprising:

an outer surface;

an inner surface adapted to abut against the turbine blade, the outer surface and inner surface defining a thickness of said shroud; and at least one aperture including a sidewall extending through the thickness of said shroud, said sidewall having a curved surface configured for engaging the tenon when the tenon is deformed to fill said aperture.

19. The shroud in accordance with claim 18, in which the curved surface is concave.

20. The shroud in accordance with claim 19, in which a tenon outer surface is substantially coincident with the outer surface.

21. The shroud in accordance with claim 18, in which the curved surface is convex.

* * * * *